United States Patent [19]

Buchan et al.

[11] 4,440,818

[45] Apr. 3, 1984

[54] FLOOR MAT CONNECTOR DEVICE

[75] Inventors: Walter Buchan, Norton, Mass.; Paul P. Cardin, Woonsocket; Norman M. Fain, Providence, both of R.I.

[73] Assignee: Teknor Apex Company, Pawtucket, R.I.

[21] Appl. No.: 481,051

[22] Filed: Mar. 30, 1983

[51] Int. Cl.[3] ..... B32B 3/12

[52] U.S. Cl. ..... 428/99; 52/581; 52/582; 428/117; 428/118

[58] Field of Search ..... 428/17, 23, 57, 62, 428/99, 117, 118, 582, 583, 593; 46/26; 52/181, 578, 581, 582; 410/154

[56] References Cited

U.S. PATENT DOCUMENTS

| | | | |
|---|---|---|---|
| 3,420,275 | 1/1969 | Glen et al. | 46/26 X |
| 3,611,609 | 10/1971 | Reijnhard | 46/26 X |
| 4,222,695 | 9/1980 | Sarides | 428/44 X |
| 4,296,160 | 10/1981 | Forlenza | 428/117 |
| 4,372,705 | 2/1983 | Atkinson | 46/26 X |

*Primary Examiner*—Henry F. Epstein
*Attorney, Agent, or Firm*—Salter & Michaelson

[57] ABSTRACT

A connector device for interconnecting a pair of adjacent floor mats wherein the mats are of the type having a rubberized base portion with a plurality of apertures therethrough and a plurality of supporting feet which extend integrally downwardly from the base portion to maintain it in upwardly spaced relation to a supporting surface. The connector device includes a connector body and a plurality of upwardly extending connector elements which are attached to the body. The connector elements are receivable in apertures adjacent the peripheries of a pair of abutting floor mats with the connector body extending between the mats. Plugs or the like are permanently securable in the connector elements in one of the mats to permanently secure the connector device thereto.

10 Claims, 4 Drawing Figures

FLOOR MAT CONNECTOR DEVICE

BACKGROUND AND SUMMARY OF THE INVENTION

The instant invention relates to floor mats and the like and more particularly to a connector device for interconnecting adjacent floor mats of the type frequently used in commercial and/or industrial applications.

Heavy duty floor mats are widely used in commercial and/or industrial applications to provide slightly cushioned nonskid walking surfaces. In this regard, floor mats of the type comprising a base portion which is made of a rubberized material and which has a plurality of apertures therethrough and a plurality of supporting feet or the like which extend integrally downwardly from the base portion have proven to be most effective. Water and other liquids can drain through the apertures in the base portion of a mat of this type onto a supporting surface therebeneath and the supporting feet, which maintain the base portion in upwardly spaced relation, allow the water and liquids to drain from the supporting surface. In some instances it has proven to be desirable to cover large areas of floor space with mats of this type. However, because National Sanitation Foundation Standards limit the weights such mats to no greater than 40 pounds, it has not been possible to cover large areas of floor space with single floor mats. Hence, the use of a plurality of floor mats which are disposed in adjacent or abutting relation has proven to be the only solution for covering large areas of floor space with mats of the above described type. However, it has been found that this is not an entirely effective solution unless the adjacent mats are properly interconnected.

Heretofore, floor mats of the above described type have generally been interconnected either with connector portions which are integrally molded into the peripheral portions of the mats or with separate connector pieces. In this regard, mats with integrally molded connector portions have been interconnectable with the connector portions thereof received in the apertures of adjacent mats. However, integrally molded connector portions have generally been somewhat ineffective because they have been prone to inadvertent disengagement during movement of the mats such as during cleaning operations. Further, when mats of this type are cut or tailored to particular sizes it has frequently been necessary to cut off the connector portions thereof. The separate connector pieces heretofore available have been operable to interconnect adjacent mats by engaging the mats within the apertures thereof but have also been prone to inadvertent disengagement during cleaning operations.

The instant invention provides a novel and effective connector device for interconnecting pairs of adjacent floor mats and comprises a connector body and first and second connector elements which extend from the body and are receivable in apertures adjacent the peripheries of a pair of adjacent mats. Also included in the connector device is means for preventing the withdrawal of the second connector element from its respective aperture whereby the connector device is permanently securable to one of the mats. Both the first and second connector elements are preferably dimensioned so that they are snugly receivable in the apertures in the respective mats and hence not easily inadvertently disengageable. Preferably, the means which prevents the withdrawal of the second connector element from its respective aperture comprises a plug element having an enlarged cap portion which engages the base portion of the respective mat to prevent the second connector element from being withdrawn. Further, the connector device preferably comprises a pair of said first connector elements, a pair of said second connector elements and a pair of said plug elements to more positively interconnect adjacent mats. The connector device of the instant invention is particularly effective for use in combination with mats of the type disclosed in the assignee's copending U.S. application Ser. No. 445,544 entitled "Floor Mat Construction". In this regard, the floor mat disclosed in application Ser. No. 445,544 includes a base portion having a plurality of apertures therethrough, wherein the upper portions of the apertures are of substantially hexagonal configuration and define a honeycomb-like structure in the mat and the lower portions of the apertures are of substantially circular configuration and of smaller dimension than the upper portions. When used in combination with mats of this type, the connector device of the instant invention is preferably embodied so that the connector elements thereof are substantially circular and snugly receivable in the lower portions of apertures adjacent the peripheries of the mats. The plug elements are preferably formed so that the cap portions thereof are of substantially hexagonal configurations and are snugly receivable in the upper portions of the apertures and so that the top surfaces of the cap elements are level with or slightly below the upper surface of the respective mat base portion. Accordingly, the connector device is permanently securable to one of the mats by using the plug elements and detachably securable to the other of the mats whereby the mats can be disconnected if desired.

Accordingly, it is a primary object of the instant invention to provide an effective device for interconnecting adjacent floor mats.

Another object of the instant invention is to provide an effective device for interconnecting floor mats which can be permanently attached to one of the mats.

A still further object of the instant invention is to provide an effective connector device for floor mats which does not cause excessive dirt accumulation.

Other objects, features and advantages of the invention shall become apparent as the description thereof proceeds when considered in connection with the accompanying illustrative drawings.

DESCRIPTION OF THE DRAWING

In the drawings which illustrate the best mode presently contemplated for carrying out the present invention.

DESCRIPTION OF THE INVENTION

Figure 1:
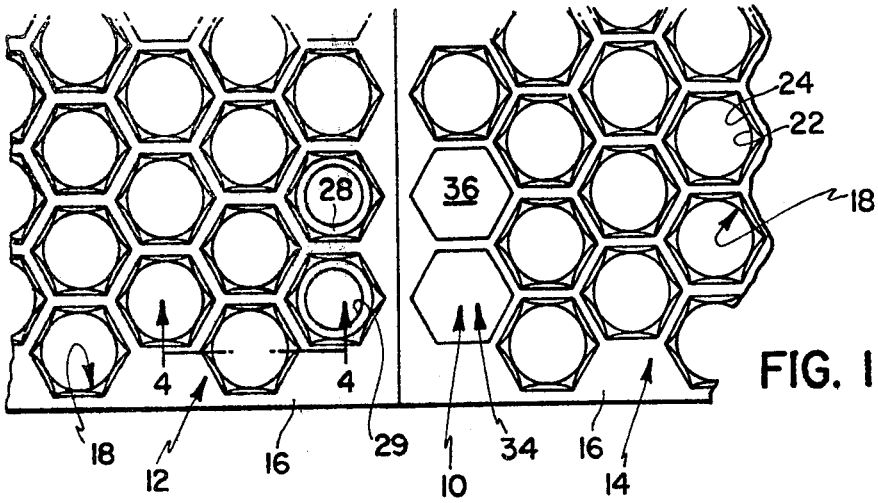
FIG. 1 is a fragmentary top plan view of a pair of floor mats which are interconnected with a connector device of the instant invention.
Figure 2:
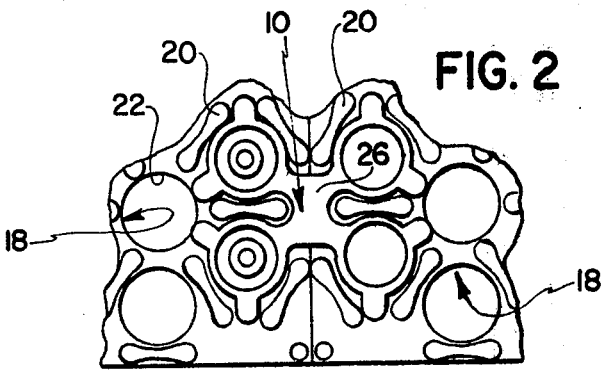
FIG. 2 is a fragmentary bottom plan view of the interconnected mats.
Figure 3:
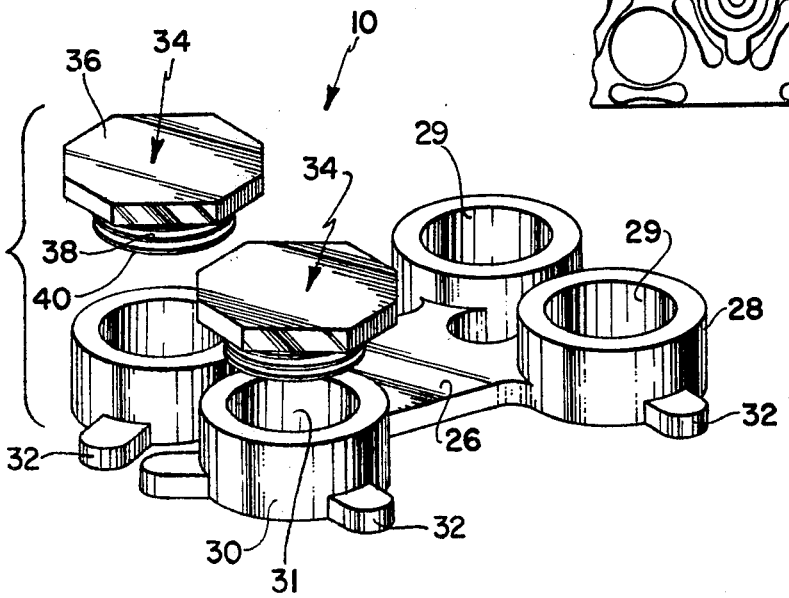
FIG. 3 is an enlarged exploded perspective view of the connector device per se.

Referring now to the drawings, the connector device of the instant invention is illustrated in FIGS. 1–3 and generally indicated at 10. As illustrated in FIGS. 1 and 2, the connector device 10 is operable to interconnect a first floor mat which is generally indicated at 12 to a second floor mat which is generally indicated at 14.

It will be understood that the connector device of the instant invention is usable in combination with a variety of floor mats of the general type comprising a base portion having a plurality of apertures therethrough and a plurality of supporting feet or the like which maintain the base portion thereof in at least slightly upwardly spaced relation when the mat is positioned on a supporting surface. Further, it will be understood that the various embodiments of the connector device of the instant invention will be dimensioned and configured to adapt them for use in combination with particular floor mats of various types and configurations. In the preferred embodiment herein set forth the device 10 is adapted for use in combination with the mats 12 and 14 which are exemplary of the type mat disclosed in the assignee's copending U.S. patent application Ser. No. 445,544. In this regard, the mats 12 and 14 each comprise a base portion 16 having a plurality of aligned apertures generally indicated at 18 therethrough and a plurality of supporting feet 20 which extend integrally downwardly from the base portion 16 thereof whereby the mats 12 and 14 are positionable on a supporting surface with the base portions 16 in slightly upwardly spaced relation thereto. As will be seen most clearly from FIG. 1, the apertures 18 include substantially circular lower portions 22 and substantially hexagonal upper portions 24 which are of slightly greater dimension than the lower portions 22. The apertures 18 are disposed in aligned adjacent rows in the mats 12 and 14 and cooperate to define honeycomb-like structures in the upper portions thereof. The feet 20 are preferably of slightly barbell-like configuration and extend downwardly from the bottom surfaces of the base portions 16 around the peripheries of the circular lower portions 22 of the apertures 18.

The connector device 10 comprises a substantially flat connector body 26, a pair of spaced upwardly extending first connector elements 28 which have openings 29 therethrough and which are attached to one end of the body 26, a pair of spaced upwardly extending second connector elements 30 which have openings 31 therethrough and which are attached to the opposite end of the connector body 26, and a plurality of connector feet 32 which extend outwardly around the lower peripheries of the elements 28 and 30. Also included in the connector 10 is a pair of plug elements 34 which are received in the openings 31 in the second connector elements 30.

The connector body 26, the first connector elements 28, the second connector elements 30, and the connector feet 32 are all preferably integrally molded from a suitable rigid plastic material such as polypropylene and are preferably dimensioned and configured substantially as illustrated in FIG. 2. Specifically, the connector elements 28 and 30 are preferably dimensioned so that they are snugly receivable in the lower portions 22 of the apertures 18 in the mats 12 and 14, respectively. The body 26 and the connector feet 32 are dimensioned and configured so that they are receivable adjacent the bottom surfaces of the base portions 16 without interference from the mat feet 20 with the body 26 extending between the mats 12 and 14. The body 26 and the connector feet 32 are dimensioned so that they are of a thickness which is not substantially greater than the height of the mat feet 20, and preferably of substantially the same thickness as the height of the mat feet 20.

Figure 4:
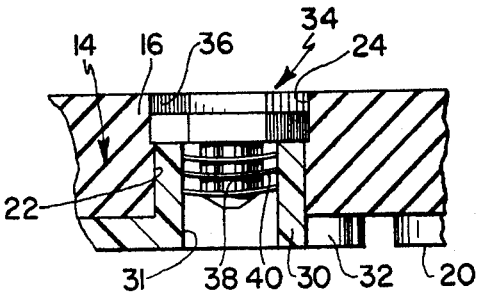
FIG. 4 is an enlarged sectional view taken along line 4—4 in FIG. 1.

The plug elements 34 are also preferably molded of a suitable rigid plastic material such as polypropylene and each comprises a hexagonal cap portion 36, a shaft portion 38 which extends downwardly from the cap portion 36 thereof and a plurality of slightly resilient annular rings 40 which extend outwardly from the shaft portion 38 thereof. The cap portions 36 are dimensioned to be snugly received in the upper portions 24 of the apertures 18 and the rings 40 are dimensioned to be snugly received in slightly resiliently deflected dispositions in the openings 31 in the connector elements 30 with the outer extremities of the rings 40 in frictional engagement with the walls of the openings 31. In this regard, as illustrated in FIG. 4, when a plug element 34 is inserted into one of the openings 31, the rings 40 of the plug element 34 are resiliently deflected slightly as they pass along the inner walls of the opening 31 to provide a locking effect which effectively prevents the subsequent removal of the plug element 34 from the opening 31 and, therefore, also prevents the removal of the connector device 10 from the mat 14.

In use and operation of the connector device 10, the mats 12 and 14 are positioned in abutting relation as illustrated in FIG. 1, the first connector elements 28 are inserted into a pair of the apertures 18 adjacent the periphery of the first mat 12 and the second connector elements 30 are inserted into a pair the apertures 18 adjacent the periphery of the second mat 14. A pair of the plug elements 34 is then inserted into the openings 31 in the connector elements 30 so that the upper surfaces of the cap portions 36 are level with or slightly below the upper surface of the mat 14. By this procedure the connector device 10 is permanently secured to the mat 14 and detachably secured to the mat 12. In this regard, because the connector elements 28 are snugly received in the apertures 18 in the mat 12, in most cases the accidental disengagement of the mat 12 from the device 10 is avoided so that the mats 12 and 14 normally remain interconnected but can be disconnected when desired. Obviously, it will be understood that the mats 12 and 14 can also be permanently interconnected by using an additional pair of the plug elements 34 in the openings 29 in the first connector elements 28 although in most instances this may not be desirable or necessary. Also, because the connector elements 28 are of tubular configuration when they do not have plug elements 34 therein, water and other liquids can pass through the openings 29 and onto a supporting surface beneath the mat 12 and because the cap portions 34 are positionable so that they are level with or slightly below the upper surface of the mat 14, they do not project upwardly on the walking surface. Further, the body 26 and the connector feet 32 provide added support underneath the base portions 16 adjacent the apertures 18 in which the connector elements 28 and 30 are received.

It is seen, therefore, that the instant invention provides an effective device for interconnecting floor mats of the type herein set forth. The connector device 10 is permanently securable to one or both of the mats 12 and 14 so that they mats 12 and 14 can be either permanently or detachably interconnected. When they are detachably interconnected the mats 12 and 14 can be separated for cleaning and the like when desired. Further, if one of the mats 12 or 14 must be cut to fit in a particular area it can nevertheless be used in combination with a connector device 10. Accordingly, for these reasons as well as for the other reasons hereinabove set forth, it is seen that the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A connector device for interconnecting floor mats and the like of the type having a base portion with a plurality of apertures therethrough and a plurality of supporting feet or the like which maintain the base portion in at least slightly upwardly spaced relation to a supporting surface therebeneath, said connector device comprising:

a. a connector body having a thickness not substantially greater than the height of said supporting feet;

b. a first connector element attached to said body and extending upwardly therefrom into an aperture adjacent the periphery of a first of said mats from the underside of said first mat;

c. a second connector element attached to said body and extending upwardly therefrom into an aperture adjacent the periphery of a second of said mats from the underside of said second mat, said connector body extending between said first and second mats; and d. a plug element received in said second mat aperture from the upper side of said second mat and attached to said second connector element, at least a portion of said plug element being a greater dimension than said second mat aperture and engaging at least a portion of said second mat base portion to prevent the withdrawal of said second connector element.

2. In the connector device of claim 1, said first and second connector elements having longitudinal openings therethrough.

3. In the connector device of claim 2, said plug element being received in said second connector element opening, said portion of said plug element which is of greater dimension than said aperture comprising a cap portion of said plug element.

4. In the connector device of claim 3, said first and second connector elements being snugly received in said first and second mat apertures, respectively.

5. In the connector device of claim 3, the upper portion of said second mat aperture being of greater dimension than the lower portion thereof, said cap portion being received in said second mat aperture upper portion.

6. The connector device of claim 1, further comprising a plurality of said first connector elements attached to said body and extending into apertures adjacent the periphery of said first mat, and a plurality of said second connector elements attached to said body and extending into apertures adjacent the periphery of said second mat, said withdrawal preventing means preventing the withdrawal of a plurality of said second connector elements.

7. In the connector device of claim 5, the upper portion of said second mat aperture being hexagonal, the lower portion thereof being round, said cap portion being hexagonal and being snugly received in said hexagonal upper portion, said second connector element being round and being snugly received in said round lower portion.

8. In the connector device of claim 5, the upper surface of said cap portion being at a level which is no higher than the upper surface of said second mat base portion.

9. In the connector device of claim 1, said connector body being of substantially the same thickness as said height of said supporting feet.

10. The connector device of claim 9, further comprising a plurality of connector feet extending outwardly from the lower peripheries of said first and second connector elements and engaging said first and second mat base portions, respectively, adjacent the peripheries of said first and second apertures, respectively, to support the portions of said first and second mats which are adjacent said first and second mat apertures, respectively.

* * * * *